US007319770B2

(12) United States Patent
Roeck et al.

(10) Patent No.: US 7,319,770 B2
(45) Date of Patent: Jan. 15, 2008

(54) METHOD OF PROCESSING AN ACOUSTIC SIGNAL, AND A HEARING INSTRUMENT

(75) Inventors: Hans-Ueli Roeck, Hombrechtikon (CH); Manuela Feilner, Herrliberg (CH)

(73) Assignee: Phonak AG, Stafa (CH)

( * ) Notice: Subject to any disclaimer, the term of this patent is extended or adjusted under 35 U.S.C. 154(b) by 436 days.

(21) Appl. No.: 10/836,683

(22) Filed: Apr. 30, 2004

(65) Prior Publication Data

US 2005/0244023 A1 Nov. 3, 2005

(51) Int. Cl.
*H04R 25/00* (2006.01)

(52) U.S. Cl. ..... 381/321; 381/107

(58) Field of Classification Search ..... 381/321, 381/66, 317, 318, 93, 63, 106, 107, 108
See application file for complete search history.

(56) References Cited

U.S. PATENT DOCUMENTS

| | | | | |
|---|---|---|---|---|
| 3,111,186 A | * | 11/1963 | Schroeder | 73/586 |
| 4,069,395 A | | 1/1978 | Nash | |
| 4,087,633 A | | 5/1978 | Fitzwilliam | |
| 4,131,760 A | | 12/1978 | Christensen et al. | |
| 4,571,461 A | * | 2/1986 | Uno et al. | 379/388.06 |
| 5,668,794 A | * | 9/1997 | McCaslin et al. | 370/288 |
| 5,774,562 A | | 6/1998 | Furuya et al. | |
| 5,793,875 A | | 8/1998 | Lehr et al. | |
| 6,757,395 B1 | * | 6/2004 | Fang et al. | 381/94.3 |
| 7,095,256 B1 | * | 8/2006 | Zhak et al. | 327/58 |
| 2005/0147262 A1 | * | 7/2005 | Breebaart | 381/106 |

FOREIGN PATENT DOCUMENTS

| | | |
|---|---|---|
| EP | 0 719 028 B1 | 7/2003 |
| WO | 00/60830 | 10/2000 |
| WO | 03/053033 A1 | 6/2003 |

OTHER PUBLICATIONS

Lebart, K et al: "A New Method Based on Spectral Substraction for Speech Dereverberation." ACUSTICA, vol. 98 (2001) 359-366.

* cited by examiner

*Primary Examiner*—Sinh Tran
*Assistant Examiner*—Joseph Saunders, Jr.
(74) *Attorney, Agent, or Firm*—Pearne & Gordon LLP

(57) ABSTRACT

A method of processing an acoustic input signal into an output signal in a hearing instrument includes converting the acoustic input signal into a converted input signal, and applying a gain to the converted input signal to obtain the output signal. According to the invention, the gain is calculated using a room impulse attenuation value being a measure of a maximum negative slope of the a converted input signal power on a logarithmic scale. The calculation of the gain may include evaluating a signal power development value being a measure of the actual converted input signal power attenuation or signal power increase, evaluating a signal-to-reverberation-noise ratio from the signal power development value and the room impulse attenuation value, and calculating, based on a gain rule, said gain from said signal-to-reverberation-noise ratio.

15 Claims, 3 Drawing Sheets

METHOD OF PROCESSING AN ACOUSTIC SIGNAL, AND A HEARING INSTRUMENT

FIELD OF THE INVENTION

This invention is in the field of processing signals in or for hearing instruments. It more particularly relates to a method of converting an acoustic input signal into an output signal, a hearing instrument, and to a method of manufacturing a hearing instrument.

BACKGROUND OF THE INVENTION

Reverberation is a major problem for hearing impaired persons. The reason is that, in addition to the missing spectral cues for speech intelligibility from the broadening of the auditory filters (i.e. the reduced spectral discrimination ability of the impaired ear, due to defect outer hair cells, resulting in less sharply tuned auditory filters in the impaired ear), the temporal cues also are mitigated by the reverberation. Onsets, speech pauses etc. are no longer perceivable. Thus, severe intelligibility reductions as well as comfort decreases occur.

From a technical point of view, reverberation is a filtering (convolution) of the clean signal, for example a speech signal, with the room impulse response (RIR) from the speaker to the hearing impaired person. These room impulse responses tend to be very long, in the order of several hundred milliseconds up to several seconds for large cathedrals or main train stations. The long RIR thus slurs the speech pauses.

The immediate technical solution therefore is so called 'de-convolution', i.e. the estimation and inversion of the RIR, with which the reverberated signal arriving at the Hearing Instrument (HI) can get filtered and thus perfectly restored to the original clean or 'dry' signal. From a mathematical point of view, deconvolution or inversion of a filter response is a well known process. The problems lie in the following points:

a.) The fact that the inversion of a real RIR generates an acausal filter, i.e. one which needs information from the future. This can in principle only be eliminated by introducing an appropriate delay into the system, which therefore would have to be several hundred milliseconds long at least.

b.) Estimation of the correct RIR (or directly the inverted version of it).

Concerning point a.), even when only the first part of the RIR (the one with the highest energies) gets corrected for, far too long delays for hearing instrument (HI) purposes would be required.

Even more important though is the correct estimation of the RIR (point b.), which is considered a hard problem in the field to solve, and no completely satisfying and useful solutions exist.

For these reasons, instead of deconvolution other approaches are used for dereverberation. One known solution uses multiple microphones or a beamformer to dereverberate the signal. This, however, is of limited use in large rooms, where the sound field is very diffuse.

Another known solution tries to dereverberate by transforming the signal first into cepstral domain, where the (estimated) RIR can simply get subtracted, before transforming back into the linear time domain. These solutions are computationally not cheap either, and also require a significant group delay. Also, they are not very robust.

A novel solution was presented in K. Lebart et al., acta acustica vol. 87 (2001), p. 359-366. The solution is a method based on spectral subtraction. The principle is that the RIR is modeled to be a zero mean Gaussian noise which decays exponentially:

$$h(t)=b(t)\cdot e^{-\Delta t} \text{ for } t\geqq 0 \text{ and}$$

$$h(t)=0 \text{ for } t<0 \quad (1)$$

In the above equation, b(t) denotes a zero mean Gaussian function and $$\Delta = \frac{3\cdot \ln(10)}{T_r},$$

$T_r$ being the reverberation time, i.e. the time after which the reverberation energy decayes by 60 dB.

The reverberation energy at any time t can thus be estimated by $$P_{rr}(t,f)=e^{-2\Delta T}\cdot P_{xx}(t-T,f) \quad (2)$$

where $P_{xx}(t,f)$ is the power spectral density of a signal x(n). T is an (arbitrary) delay.

In other words, the reverberation power at any time t is equal to the signal power of the speaker at an earlier time t−T, and attenuated by the exponential term $e^{-2\Delta T}$.

One can now consider the ratio between the current received signal power and the estimated reverberation signal power as a 'Signal-to-reverberation-Noise Ratio (SNR)' and form a spectral subtraction filter like gain function from it. However, musical noise artifacts may get produced and have to be avoided by additional means like averaging or setting a spectral floor.

An algorithm based on these findings is of lower complexity than above mentioned direct dereverberation or cepstral methods, but is still computational expensive. In particular, the reverberation time $T_r$, which is required in order to generate the exponential term in Eq. (2) for the reverberation power estimation, is hard to calculate: First, speech pauses are detected (which is rather difficult in a highly reverberated signal). During speech pauses, the exponential decay corresponds to a linear negative slope on a logarithmic scale. Then, within these signal segments the slope of the smoothed signal power envelope on a dB scale is extracted by linear regression, another quite expensive operation. Further averaging of the found slopes are used to come up with an improved estimate. From the slope estimate and the known sample time, $T_r$ can get extracted.

Next to being computationally expensive, the above described method also lacks a certain amount of robustness. This is, among other reasons, due to uncertainties in detecting speech pauses.

SUMMARY OF THE INVENTION

It is an object of this invention to provide a method and a device for suppressing reverberation, which method is robust, is computationally not expensive, and avoids drawbacks of corresponding prior art methods. More concretely, it is an object of the invention to provide a method of obtaining an output signal from an acoustic input signal, which method causes reverberation contributions to the acoustic input signal to be suppressed in the output signal.

The method should be computationally inexpensive, robust and should overcome drawbacks of according prior art methods.

An embodiment of the invention provides, in a hearing instrument, a method of converting an acoustic input signal into an output signal. The method comprises the steps of converting the acoustic input signal into a converted input signal, and of applying a gain to the converted input signal to obtain the output signal, and further comprises the steps of determining a converted signal power value from the converted input signal determining a room impulse attenuation value being a measure of a maximum negative slope of the logarithm of a converted signal power value as a function of time, and of carrying out a gain calculation based on said room impulse attenuation value, which calculation yields said gain applied to the converted input signal.

Another embodiment of the invention concerns a hearing instrument comprising an input transducer to convert an acoustic input signal into a converted input signal, at least one gain unit, and an output transducer, wherein the input transducer is operatively connected to the output transducer via the gain unit, and wherein a gain value for the gain unit is adjustable, and further comprising gain calculating means including a room impulse attenuation evaluating unit operable to determine a room impulse attenuation value being a measure of a maximum negative slope of the logarithm of the converted input signal power as a function of time, said gain calculating means being operable to calculate a gain based on said room impulse attenuation value.

Yet another embodiment of the invention provides a method for manufacturing a hearing instrument. The method comprises the steps of providing an input transducer to convert an acoustic input signal into a converted input signal, of providing at least one gain unit, of providing output transducer, and of operatively connecting the input transducer to the output transducer via the gain unit, wherein a gain value for the gain unit is adjustable, and further comprises the steps of providing gain calculating means including a room impulse attenuation evaluating unit operable to determine a room impulse attenuation value being a measure of a maximum negative slope of the logarithm of the converted input signal power as a function of time, said gain calculating means being operable to calculate a gain based on said room impulse attenuation value, and of operatively connecting the gain calculating means with the gain unit.

According to these principles, a room impulse attenuation value is evaluated over a reasonably long observation time period. This is done for a converted acoustic input signal, i.e. a signal provided by a transducer and possibly also digitized, optionally split into frequency bands, smoothed and/or otherwise further processed. The room impulse attenuation value is a value that is determined for the converted input signal and is a measure of the maximum negative slope of its power on a logarithmic scale. Based on this and on a measure of the signal evaluation, a signal-to-reverberation-noise ratio is evaluated by comparing the signal evolution (i.e. its attenuation or increase) with the room impulse attenuation value. This signal-to-reverberation-noise ratio serves as basis for calculating a gain to be applied to the converted input signal, so that an output signal is obtained.

This course of action is based on the insight that a signal that attenuates with the maximum attenuation rate is, with a high probability, caused by reverberation. On the other hand, the higher the difference between the actual attenuation and the maximum attenuation rate, the better the signal-to-reverberation-noise-ratio. When applying a gain rule, one may use this insight and suppress the converted input signal whenever said ratio is small. In principle, the gain rule may be regarded to be based on a comparison between the room impulse attenuation being the maximal attenuation in the current environment, and the actually observed observation.

A "Comparison" in this context is a mathematical operation operating on two input values (or their absolute values or envelopes, respectively) that yields an output value indicative of the relative size of one of the input values with respect to the other one. Examples of comparisons are a subtraction, a weighed subtraction, a division etc.

The terms "signal power" and "logarithm of the signal power" generally denote a value that is indicative of the signal power or signal 'strength', or its logarithm respectively. Such a value may be the physical signal power, the signal envelope or the absolute value of the signal etc.

The gain as a function of the room impulse attenuation may be a monotonously increasing function. A monotonously increasing function g is a continuous or not continuous function if it fulfills $g(x) \geqq g(y)$ for all $x>y$. For example, the gain may be at a maximum if the signal-to-reverberation noise ratio is large and small if the signal-to-reverberation noise ratio is small and may further be continuously and monotonously increasing as a function of the signal-to-reverberation-noise ratio in between. It may, as an alternative also be a monotonously increasing and stepped function of the reverberation signal-to-noise ratio.

A measure of the signal evaluation may be obtained by calculating the difference between the converted signal input power and the converted signal input power delayed by a delay T. Then, the room impulse attenuation value may be chosen to be the maximum attenuation during a time span corresponding to T, as observed during a much larger time period I. In other words, the room impulse attenuation value RIatt used is the maximum negative slope multiplied by T. (The negative slope itself is not required and does not have to be calculated, though). Several maximum values during the time period I may get averaged to increase robustness.

The delay time T may be set to a value between 5 ms and 100 ms, preferably between 10 ms and 50 ms.

The time period I over which the room impulse attenuation value is evaluated, in addition to being larger than the delay T, is preferably also substantially larger than a typical speech pause. It may for example be between 1 s and 20 s. The room attenuation value is only slowly time dependent. It gets regularly updated. The time window I, over which the maximum Room impulse attenuation Riatt is evaluated, may, as an alternative to being rectangular, also be exponential or otherwise shaped, i.e. may weight maximum values lying further in the past less then more recent maximum values. The window may also be sliding instead of being fixed.

Preferably, the converted input signal power is smoothed before the Room Impulse attenuation value is determined. Smoothing methods as such known in the art may be used for this purpose. Preferably, the time constants for the smoothing operation are smaller than $T_r$, at least by a factor of 2 and preferably by a factor between 3 and 10. In order to ensure this relation independently of the actual reverberation time, a feedback function may be provided. According to this feedback function, the determined room impulse attenuation value—or a quantity derived therefrom—is fed to the smoothing stage as filter constant setting value.

The method according to the invention, although its basic principle is comparable to the one of prior art methods, is surprisingly simple and computationally significantly cheaper. It makes use of quantities often already available in a hearing instrument, such as logarithmic signal power etc. Compared to the above described prior art method by K. Lebart et al., it avoids the explicit complex and computationally expensive estimation of the reverberation time $T_r$ in order to generate the exponential term in eq. (2) for the reverberation power estimation.

Next to providing a far simpler solution for the estimation of the reverberation time $T_r$, or a measure for it, respectively, it also allows to implement a simpler gain rule. Therefore, it is computationally efficient. Computational efficiency is still of prime importance in hearing instruments. By also eliminating the error-prone step of speech pause detection, robustness is improved as well.

It is further noted that the sensitivity on RIatt estimation errors is quite low, i.e. significant estimation errors in the order of ca. 20.40% are not readily audible. Thus a simplified inversion algorithm for a calculation of 1/RIatt for a gain rule may get used as well. I.e., the inversion algorithm may be implemented with a simple lookup table with only a few entries and possibly even without interpolation in between.

The term "hearing instrument" or "hearing device", as understood here, denotes on the one hand hearing aid devices that are therapeutic devices improving the hearing ability of individuals, primarily according to diagnostic results. Such hearing aid devices may be Outside-The-Ear hearing aid devices or In-The-Ear hearing aid devices. On the other hand, the term stands for devices which may improve the hearing of individuals with normal hearing e.g. in specific acoustical situations as in a very noisy environment or in concert halls, or which may even be used in context with remote communication or with audio listening, for instance as provided by headphones.

The hearing devices addressed by the present invention are so-called active hearing devices which comprise at the input side at least one acoustical to electrical converter, such as a microphone, at the output side at least one electrical to mechanical converter, such as a loudspeaker, and which further comprise a signal processing unit for processing signals according to the output signals of the acoustical to electrical converter and for generating output signals to the electrical input of the electrical to mechanical output converter. In general, the signal processing circuit may be an analog, digital or hybrid analog-digital circuit, and may be implemented with discrete electronic components, integrated circuits, or a combination of both.

BRIEF DESCRIPTION OF THE DRAWINGS

In the following, principles of the invention are explained by means of a description of preferred embodiments. The description refers to drawings with Figures that are, with the exception of FIGS. 1 and 2, all schematic. The figures show the following.

DESCRIPTION OF THE PREFERRED EMBODIMENTS

Figure 1:
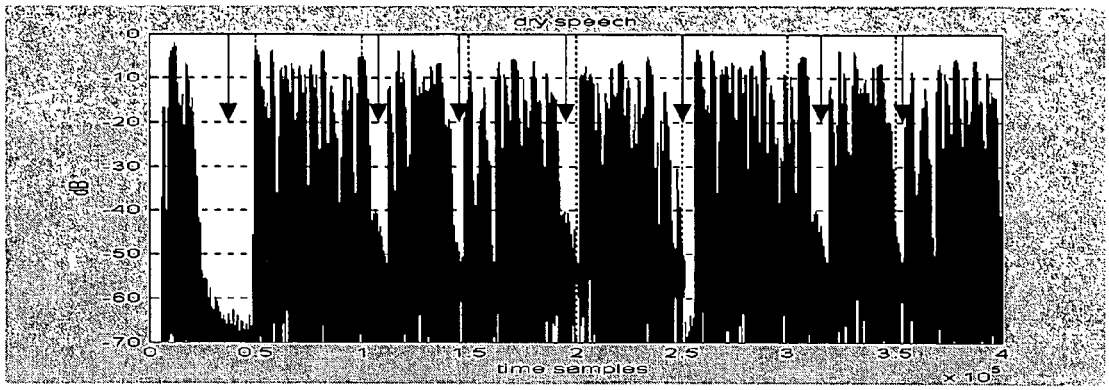
FIG. 1 the signal power of a dry (not reverberated) speech signal, showing the nonlinear negative slopes in the speech pauses.

FIG. 1 depicts, on a logarithmic scale, the signal power of a dry (not reverberated) speech signal as a function of time, showing the nonlinear negative slopes in the speech pauses. In the figure, the speech pauses are pointed out by arrows.

Figure 2:
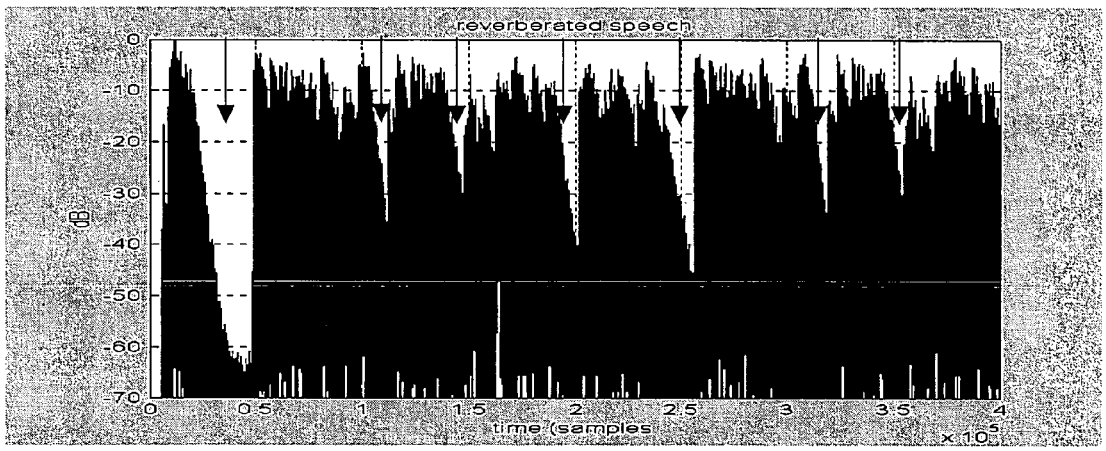
FIG. 2 the signal power of a reverberated speech signal, showing the approximately linear negative slopes in the speech pauses.

FIG. 2 shows the corresponding plot of approximately the same speech signal, which however is reverberated. In the speech pauses, the approximately linear negative slopes may be seen. For hearing instrument users, the blurring of speech pauses by reverberation may decrease speech intelligibility.

Figure 3:
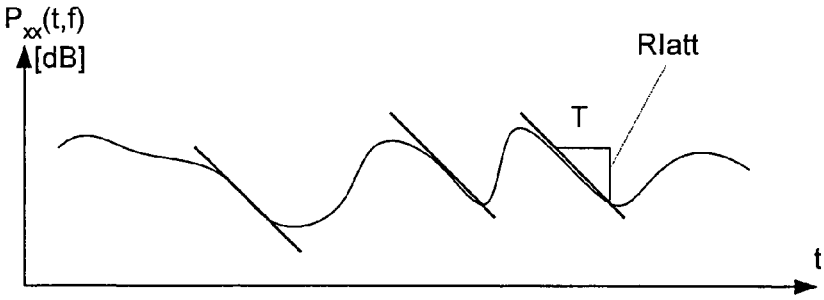
FIG. 3 an example envelope of a reverberated speech signal with the maximum negative slopes shown with thick lines FIG. 4 a block diagram of an embodiment of a hearing instrument according to the invention FIG. 5 a block diagram of a part of the hearing instrument illustrating the signal processing FIGS. 6*a*, 6*b*, and 6*c*, plots of examples of gain rules FIG. 7 a block diagram of a part of a further embodiment of a hearing instrument according to the invention.

An important finding of the invention is, that the maximal negative slope found over such a (properly pre-processed) signal envelope is a good indicator of the reverberation time $T_r$. In other words, even for immediate drops in the (speech) signal, the reverberated signal will never decay faster than given by $T_r$. FIG. 3 shows this relation. The power $P_{xx}$ of a reverberated speech signal in a frequency band f (here, f is a discrete variable) is plotted as a function of the time. Thick lines show secants (approximating tangents) at places with maximum negative slopes. RIatt (the Room Impulse ATTenuation) is defined to be the attenuation at places with maximum negative slopes during a time T, as shown in FIG. 3. Typical values of T are between 10 ms and 50 ms, for example 20 ms.

RIatt is the attenuation of the room impulse response after a short sound energy burst seen over a time period T when no other significant signal energy is present anymore, determined on a logarithmic scale. It is related to $T_r$ by:

$$RIatt(f) = \frac{T(f) \cdot 60\ \text{dB}}{T_r(f)} \tag{3}$$

where the arbitrary time delay T as well as the actual reverberation time may be frequency dependent. RIAtt is only slowly time variant, the time index t is thus omitted, even though the estimate of it is regularly updated.

A, signal-to-reverberation-noise ratio SNR' in the sense of Eq. (2) is defined as $$\begin{aligned} SNR_{rev}(t, f) &= \frac{P_{xx}(t, f)}{P_{rr}(t, f)} \\ &= P_{xx_dB}(t, f) - \underbrace{[P_{xx_dB}(t - T, f) - RIatt(f)]}_{P_{xx_dB}(t,f)} \end{aligned} \tag{4}$$

In general, logarithmic signal powers or levels used are also used for other purposes in a hearing instrument like gain computation, and are therefore readily available. This makes the above expression for a reverberation signal-to-noise ratio readily calculable.

Note that above SNR measure compares the received power $P_{XX}$ with the estimated reverberation power $P_{rr}$, and thus may theoretically never become negative, if RIatt(f) is properly computed, i.e. if RIatt(f)/T is the maximal negative slope found over a reasonably long observation time period. In other words, the above SNR measure compares the (maximal) attenuation a reverberation signal would have if no other signal were present with the observed signal attenuation (which attenuation would be negative in the event of a signal increase):

$$SNR_{rev}(t,f)=RIatt(f)-(P_{xx_dB}(t-T,f)-P_{xx_dB}(t,f)) \quad (4b)$$

The reverberation SNR may be used for adjusting a gain according to an appropriate gain rule: If the observed attenuation comes close to the maximal attenuation, the reverberation portion of the total signal is high, and thus the signal is suppressed.

Figure 4:
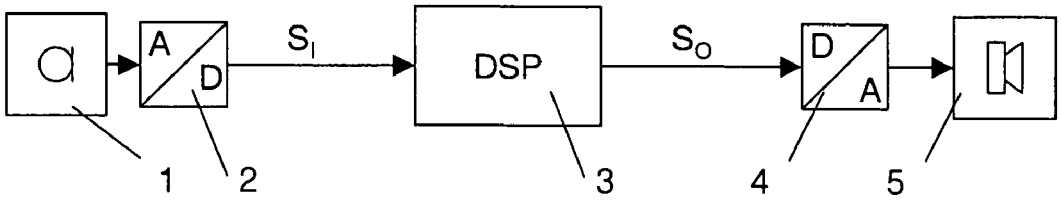

An embodiment of a hearing instrument according to the invention is schematically shown in FIG. 4. An input transducer 1 and an analog-to-digital converter 2 convert the acoustic input signal into a converted input signal $S_1$, which is a digital electric signal. The converted input signal is processed by a digital signal processor (DSP) 3. The output signal $S_O$ of the DSP is fed to a Digital-to-Analog converter 4 and, after a possible amplification stage (not shown), fed to an output transducer 5.

Figure 5:
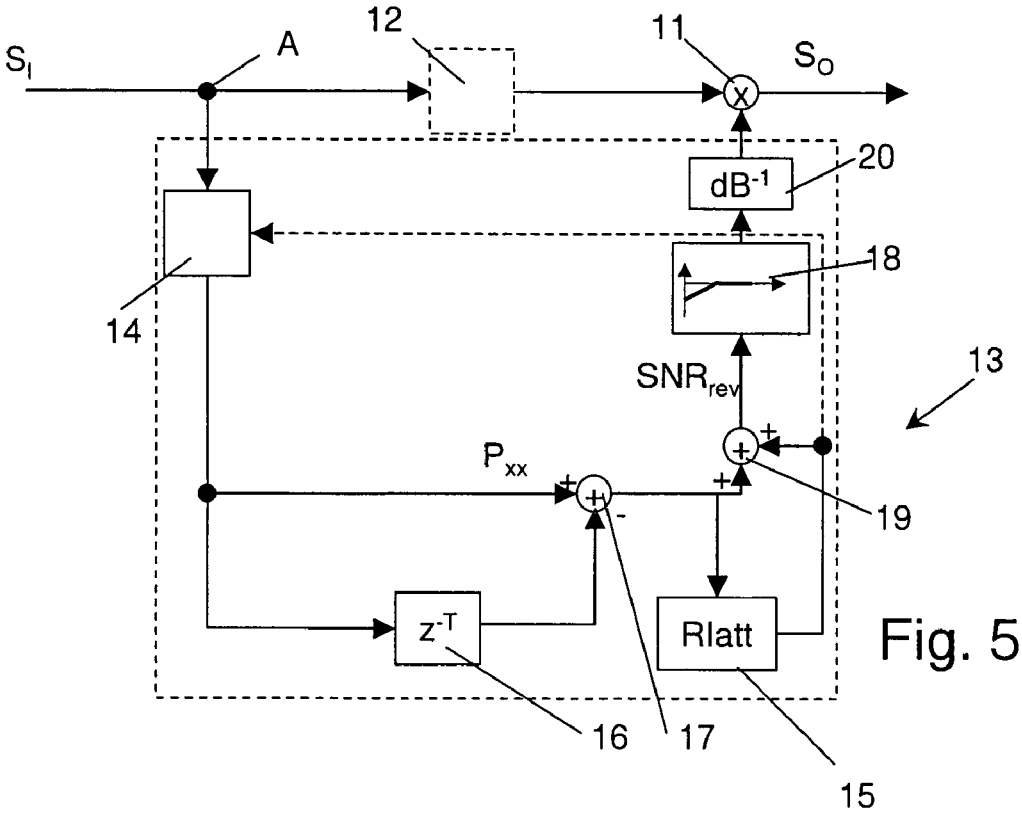

As depicted in FIG. 5, the signal path in the DSP includes a gain unit 11 for applying a reverberation-SNR dependent gain to the signal. It may include further signal processing stages 12 which may be arranged upstream of a branching point A for gain evaluating means, between the branching point A and the gain unit 11, as very schematically illustrated in the figure, and/or downstream of the gain unit 11. The further signal processing stages may comprise any signal processing algorithms known for hearing aids or yet to be invented. They are not subject of the present invention and will not be described any further here.

The gain evaluating means 13 comprise a logarithmic power computing stage 14, preferably including smoothing means. For the smoothing of the envelope, so called, dual-slope-averagers' (DSA) (or dual-slope filters) may be used, which contain different parameters for the attack—and release time constants. DSAs can follow the natural shape of a signal envelope better than normal averagers. Typical attack times for evaluation of speech signals are in the order of 5-10 ms, typical release times in the order of 50 ms. The computation of the logarithmic signal power, the smoothing as well as further steps are preferably carried out in confined frequency bands, as explained in more detail further below.

Of course, instead of being fed by the converted signal $S_I$, the logarithmic power computing and smoothing stage 14 may be provided with an already available logarithmic power signal instead. The smoothed logarithmic power signal is supplied to a delay element 16. The thus obtained delayed logarithmic power signal as well as the smoothed logarithmic power signal are fed to a first adder 17, where the delayed logarithmic power, signal is subtracted from the logarithmic power signal. This difference is actual an attenuation value (or may be considered as a signal power development value). It is supplied to a room impulse attenuation evaluating unit 15, which evaluates, over a certain time period I, the maximum attenuation RIatt during the delay T. The calculated Room Impulse Attenuation value RIatt may be stored in a temporary store and continuously output from the room impulse attenuation evaluating unit 15. By a second adder 19, the RIatt value is added to the actual attenuation value obtained by the first adder. According to eq. (4), the thus obtained value is a signal-to-reverberation-noise ratio SNR. This SNR is fed to a gain rule unit 18, which, based on the signal-to-noise ratio and a gain rule, calculates a gain for the gain unit 11. Prior to being fed to a gain rule unit, the computed gain may be converted back into the linear domain for application onto the signal $S_I$ or a therefrom derived signal, as indicated by a conversion unit 20 in the figure.

A "Gain unit" in this context, relates to a unit that alters the incoming signal in a manner dependent on the reverberation SNR, for example by multiplying or amplifying it by a factor depending on said reverberation SNR.

Figure 6A:
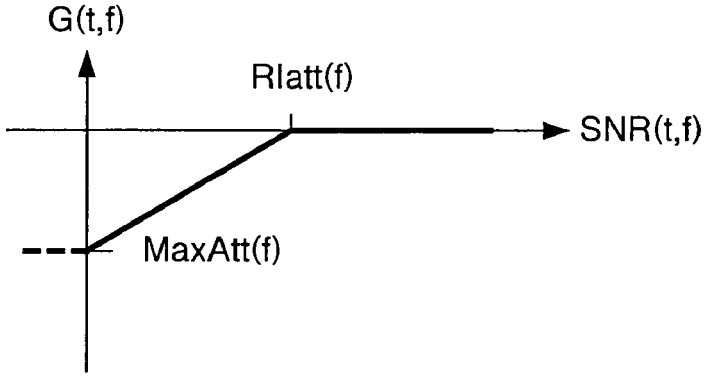

An example of a simple, but effective gain rule is depicted in FIG. 6*a*: The gain as a function of the reverberation SNR increases linearly if the reverberation SNR is smaller than RIatt (i.e. if the signal power is constant or if it decreases), and the gain attains a constant maximal value if the signal power increases as a function of time. In the figure, the maximal value is 0 (on a logarithmic scale).

Expressed as an equation, the gain rule is as follows:

$$G_{dB}(t,f)=\min\left(0,\ \frac{\mathrm{Max}Att}{RIatt(f)}\cdot(\max(0,SNR_{rev}(t,f))-RIatt(f))\right) \quad (5)$$

which may get simplified to:

$$G_{dB}(t,f)=\min\left(0,\ \max\left(\mathrm{Max}att(f)\frac{\mathrm{Max}att(f)}{RIatt(f)}\cdot(P_{xx_dB}(t,f)-P_{xx_dB}(t-T,f))\right)\right) \quad (6)$$

This equation contains the inversion of RIAtt(f), which can get computed at the same slow tick rate as RIAtt (f) itself, and is therefore computationally not expensive either. Likewise it can get approximated with a course lookup table method. Note also, that the max(.) operation is for robustness only, i.e. for negative values of $SNR_{rev}(t,f)$, which should not occur anyhow. The min(.) operation limits the gains to negative values, i.e. attenuations, such that no positive gains get applied for non-reverberation signals.

The computed gain is then either combined with other gains computed for other means (not shown in FIG. 5) or independently converted back into linear domain for application onto the signal $S_I$ or a therefrom derived signal.

Figure 6B:
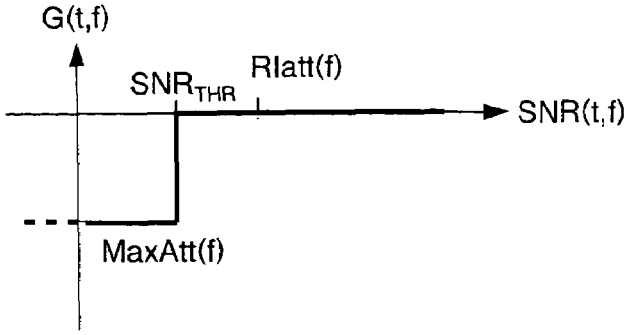
Figure 6C:
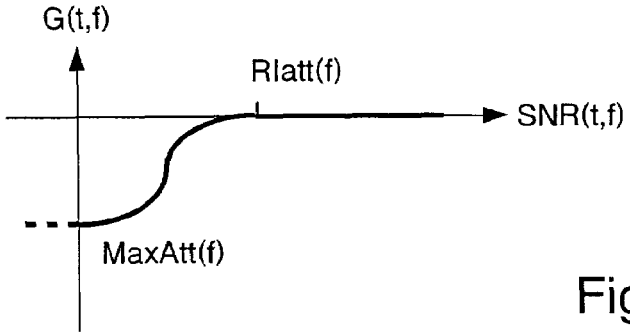

Instead of the above mentioned gain rule, other gain rules may be applied. FIGS. 6*b* and 6*c* show examples of further possible gain rules. The gain rule according to FIG. 6*b* simply cuts the signal off if the reverberation SNR is below a threshold value $SNR_{THR}$. "Cut off", in this context, means attenuation by a maximal attenuation rate MaxAtt. If the reverberation SNR is above the threshold value, the signal is not attenuated (the gain is 0 on a logarithmic scale). Other, more sophisticated stepped functions including a plurality of steps may be applied also. The gain rule according to FIG. 6*c* is, next to the one of FIG. 6*a*, an other example of a gain rule where the gain is a continuous function of the reverberation SNR.

According to a preferred embodiment of the invention, the logarithmic signal power (or level) as well as the term RIatt is computed in a plurality of frequency bands, and a gain factor is calculated in each band. Equations (1) to (5) are then all to be read as frequency dependent, as indicated by the variable $f$.

Figure 7:
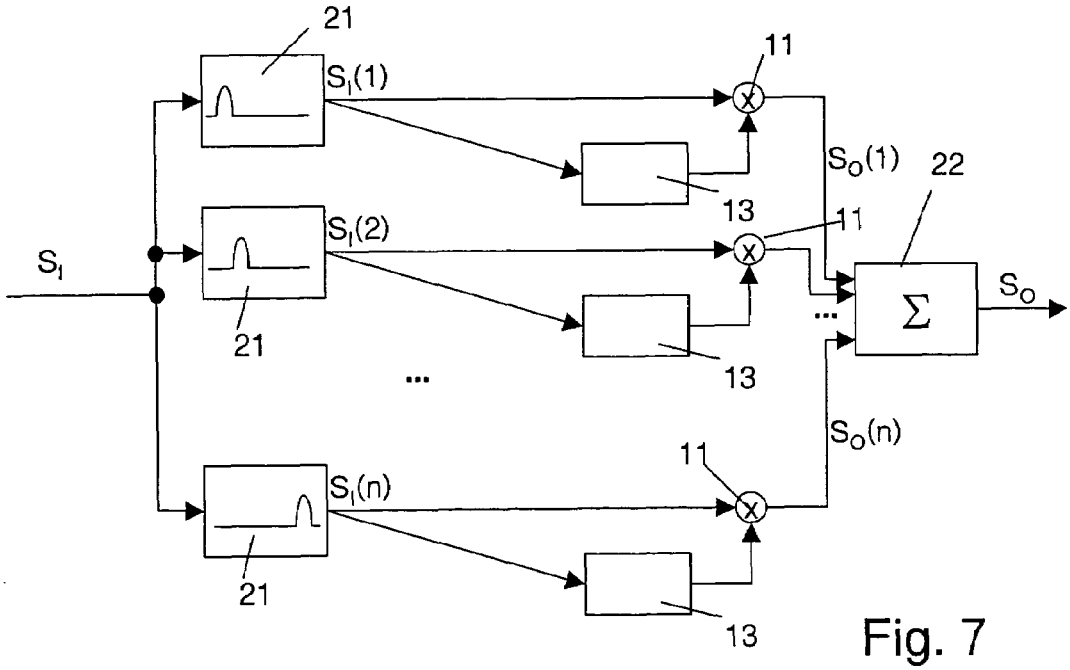

Time domain or transformation based filter banks with uniform or non-uniform frequency band-width distribution for the individual bands may be used to divide the converted input signal into individual signals for each frequency band. Examples of transform based filterbanks comprise, but are not limited to, FFT, DCT, and Wavelet based filterbanks. FIG. 7 very schematically depicts the embodiment where a gain factor is calculated in each frequency band. The converted input signal is fed to the filters 21 of the filterbank yielding a pluraltiy of input subsignals $S_I(f)$. In each frequency band, a gain evaluating means 13 of the kind described above calculates a gain factor for a gain unit 11. Individual smoothing filter parameters may be used for each frequency band. Such individual smoothing filter parameters may be adapted to a frequency band specific room impulse attenuation value in each frequency band.

The output sub-signals $S_O(f)$ obtained in each frequency band are added (or inverse transformed, respectively) by an adding stage 22 to provide an output signal $S_O$. According to a preferred embodiment, the number of frequency bands is chosen to be between 10 and 36, however, the invention applies for any number of frequency bands. Frequency bands may be chosen to be uniformly spaced on a logarithmic scale.

Next, different possibilities of obtaining RIatt values are discussed. According to a first embodiment, the following steps are applied. During a time period I, the value $$Att(t,f)=P_{xx_dB}(t-T,f)-P_{xx_dB}(t,f) \quad (7)$$

is measured every T time units. The first measured positive value of Att(t,f) is stored in a temporary store. Each subsequently measured value of Att(t,f) is compared with the stored value. If it is larger, the stored value is replaced by the measured value. The value remaining in the store after the time period I is defined to be RIatt. This procedure is repeated regularly (the repetition rate of the procedure is sometimes denoted "tick rate" in this text), and every time RIatt is evaluated anew.

This procedure is founded on the assumption that the power signal is smooth on a time scale corresponding to T. In other words, the time constants of filters of the smoothing stages have to be chosen in the range of T or larger than T. As an alternative, the value Att(t,f) may be the result of an averaging of subsequent difference values.

As an alternative to the above evaluation over time periods I, RIatt may be continually updated. Each value of Att(t,f)—evaluated according to (7)—is compared with the stored value as in the above procedure. If the measured value is higher than the stored value, the stored value is replaced by the measured value. The stored value, however, is regularly lowered by an incremental value so that the system may not be trapped once the attenuation value is high, and may adapt to a situation where the hearing instrument user gets into a situation where reverberation is enhanced.

Other procedures for updating the room impulse attenuation value may be envisaged.

The time constants of the filters (averagers) of the smoothing stage may be adapted to the actual value of RIatt, or, via equation (3) to the value of $T_r$, respectively. In FIG. 5, this is illustrated by a dashed arrow illustrating a feedback function. More concretely, time constants of the filters may for example be chosen to be proportional to $T_r$ and for example be between ½ and 1/20 of the value of $T_r$, preferably between ⅓ and 1/10 of the value of $T_r$. According to a preferred embodiment, dual slope averagers are used, wherein time constants for the dual-slope filters are made adaptive in response to the room impulse attenuation values.

Although this invention is described for digital signal processing, it may as well be implemented using analog techniques.

Various other embodiments may be envisaged without departing from the scope or spirit of the invention.

What is claimed is:

1. In a hearing instrument, a method of converting an acoustic input signal into an output signal, comprising the steps of converting the acoustic input signal into a converted input signal, determining a converted signal power value from the converted input signal determining a room impulse attenuation value being a measure of a maximum negative slope of the logarithm of a converted signal power value as a function of time, carrying out a gain calculation based on said room impulse attenuation value, which calculation yields a gain, wherein said gain calculation comprises the steps of evaluating a signal power development value being a measure of the actual converted input signal power attenuation or signal power increase, of evaluating a signal-to-reverberation-noise ratio from the signal power development value and the room impulse attenuation value, and of calculating, based on a gain rule, said gain from said signal-to-reverberation-noise ratio, and applying said gain to the converted input signal to obtain the output signal.

2. The method according to claim 1, wherein the gain rule is such that the gain monotonously increases as a function of said signal-to-reverberation-noise ratio.

3. The method according to claim 2, wherein the gain is at a maximum if the difference between the acoustic input signal power and the acoustic input signal power delayed by a delay T is positive and continuously increases as a function of the signal-to-reverberation-noise ratio if the difference between the acoustic input signal power and the acoustic input signal power delayed by a delay T time is negative.

4. The method according to claim 1, wherein said room impulse attenuation value is the absolute value of said maximum negative slope multiplied by a delay time T, and wherein said signal-to-reverberation-noise ratio is the sum of said room impulse attenuation value and the difference between the acoustic input signal and the acoustic input signal delayed by the delay time T.

5. The method according to claim 1, wherein the converted input signal power value is determined and processed in a plurality of frequency bands, wherein a room impulse attenuation value is calculated in at least one of these frequency bands, and wherein a gain factor is calculated therefrom in at least one of these frequency bands.

6. The method according to claim 5, wherein the frequency band signals in the individual frequency bands are obtained in time domain filter banks or transform based filterbanks with uniform or non-uniform frequency bandwidth distribution.

7. The method according to claim 1, wherein the converted input signal power is smoothed before the room impulse attenuation value is determined.

8. The method according to claim 7, wherein time constants of filters used for smoothing are chosen dependent on the room impulse attenuation value.

9. The method according to claim 7 wherein dual-slope-filters are used for smoothing.

10. The method according to claim 7, wherein the converted input signal power value is determined and processed in a plurality of frequency bands, wherein a room impulse attenuation value is calculated in at least one of these frequency bands, and wherein said gain calculation comprises calculating a gain factor from the room impulse attenuation value in said at least one frequency band, and wherein the signals are smoothed in said at least one frequency band, using individual smoothing filter parameters for said at least one frequency band.

11. In a hearing instrument, a method of converting an acoustic input signal into an output signal, comprising the steps of converting the acoustic input signal into a converted input signal, determining a converted signal power value from the converted input signal determining a room impulse attenuation value being a measure of a maximum negative slope of the logarithm of a converted signal power value as a function of time, carrying out a gain calculation based on said room impulse attenuation value, which calculation yields a gain, and applying said gain to the converted input signal to obtain the output signal wherein the converted input signal power value is determined and processed in a number of frequency bands, and wherein said gain calculation comprises the steps of calculating in at least one of these frequency bands, a signal power development value being a measure of the actual converted input signal power attenuation or signal power increase, of evaluating, in said at least one frequency band, a signal-to-reverberation-noise ratio from the signal power development value and a room impulse attenuation value, and of calculating, based on a gain rule, a gain factor in said at least one frequency band from said signal-to-reverberation-noise ratio.

12. A hearing instrument comprising an input transducer to convert an acoustic input signal into a converted input signal, at least one gain unit, and an output transducer, wherein the input transducer is operatively connected to the output transducer via the gain unit, and wherein a gain value for the gain unit is adjustable, the hearing instrument further comprising gain calculator including a room impulse attenuation evaluating unit operable to determine a room impulse attenuation value being a measure of a maximum negative slope of the logarithm of the converted input signal power as a function of time, said gain calculator being operable to calculate a gain based on said room impulse attenuation value, wherein said gain calculator comprises a gain rule unit operatively connected to the gain unit for providing at least one gain factor, and wherein said room impulse attenuation evaluating unit is operatively connected to said gain rule unit via an adding stage operable to add a difference between an actual signal power and a delayed signal power to the room impulse attenuation value.

13. A hearing instrument comprising an input transducer to convert an acoustic input signal into a converted input signal, at least one gain unit, and an output transducer, wherein the input transducer is operatively connected to the output transducer via the gain unit, and wherein a gain value for the gain unit is adjustable, the hearing instrument further comprising a gain calculator including a room impulse attenuation evaluating unit operable to determine a room impulse attenuation value being a measure of a maximum negative slope of the logarithm of the converted input signal power as a function of time, said gain calculator being operable to calculate a gain based on said room impulse attenuation value, wherein said gain calculator comprises a gain rule unit operatively connected to the gain unit for providing at least one gain factor, and wherein said room impulse attenuation evaluating unit is operatively connected to said gain rule unit via an adding stage operable to add a difference between an actual signal power and a delayed signal power to the room impulse attenuation value, the hearing instrument further comprising a smoothing stage with at least one filter, an output of the smoothing stage being in operative connection with the room impulse attenuation evaluating unit, and a feedback loop for adjusting time constants of said at least one filter based on room impulse attenuation values.

14. A hearing instrument comprising an input transducer to convert an acoustic input signal into a converted input signal, at least one gain unit, and an output transducer, wherein the input transducer is operatively connected to the output transducer via the gain unit, and wherein a gain value for the gain unit is adjustable, the hearing instrument further comprising a gain calculator including a room impulse attenuation evaluating unit operable to determine a room impulse attenuation value being a measure of a maximum negative slope of the logarithm of the converted input signal power as a function of time, said gain calculator being operable to calculate a gain based on said room impulse attenuation value, the hearing instrument further comprising frequency band splitters for splitting the converted input signal in a plurality of input sub-signals in separate frequency bands, and a gain unit and a gain calculation means for at least one frequency band, wherein said gain calculation means is operable to calculate a gain factor in at least one frequency band, wherein said gain calculation means comprises a gain rule unit operatively connected to the gain unit for evaluating a gain factor in said at least one frequency band, and wherein said room impulse attenuation evaluating unit is operatively connected to said gain rule unit via an adding stage operable to add a difference between an actual signal power and a delayed signal power to the room impulse attenuation value in said frequency band.

15. A method for manufacturing a hearing instrument comprising the steps of providing an input transducer to convert an acoustic input signal into a converted input signal, of providing at least one gain unit, of providing an output transducer, and of operatively connecting the input transducer to the output transducer via the gain unit, wherein a gain value for the gain unit is adjustable, the method further comprising the steps of providing a gain calculator including a room impulse attenuation evaluating unit operable to determine a room impulse attenuation value being a measure of a maximum negative slope of the logarithm of the converted input signal power as a function of time, said gain calculator being operable to calculate a gain based on said room impulse attenuation value, and of operatively connecting the gain calculator with the gain unit, wherein said gain calculator is provided such as to comprise a gain rule unit and is operatively connected to the gain unit for providing at least one gain factor, and wherein said room impulse attenuation evaluating unit is operatively connected to said gain rule unit via an adding stage operable to add a difference between an actual signal power and a delayed signal power to the room impulse attenuation value.

* * * * *